US009664137B2

(12) United States Patent
Bischofberger

(10) Patent No.: US 9,664,137 B2
(45) Date of Patent: May 30, 2017

(54) PISTON

(71) Applicant: Mahle International GmbH, Stuttgart (DE)

(72) Inventor: Ulrich Bischofberger, Esslingen (DE)

(73) Assignee: Mahle International GmbH (DE)

( * ) Notice: Subject to any disclaimer, the term of this patent is extended or adjusted under 35 U.S.C. 154(b) by 129 days.

(21) Appl. No.: 14/423,656

(22) PCT Filed: Aug. 20, 2013

(86) PCT No.: PCT/EP2013/067302
§ 371 (c)(1),
(2) Date: Feb. 24, 2015

(87) PCT Pub. No.: WO2014/033011
PCT Pub. Date: Mar. 6, 2014

(65) Prior Publication Data

US 2015/0322886 A1 Nov. 12, 2015

(30) Foreign Application Priority Data

Aug. 31, 2012 (DE) ..... 10 2012 215 541

(51) Int. Cl.
*F02F 3/16* (2006.01)
*F02F 3/22* (2006.01)

(52) U.S. Cl.
CPC ..... *F02F 3/22* (2013.01)

(58) Field of Classification Search
CPC ..... F02F 3/22
USPC ..... 123/193.6, 41.35
See application file for complete search history.

(56) References Cited

U.S. PATENT DOCUMENTS

| | | | | |
|---|---|---|---|---|
| 4,587,932 | A | 5/1986 | Moebus | |
| 7,069,881 | B2 | 7/2006 | Bing | |
| 7,484,295 | B2 | 2/2009 | Appo | |
| 8,001,946 | B2 | 8/2011 | Leitl | |
| 8,065,984 | B2 | 11/2011 | Issler et al. | |
| 2004/0244194 | A1* | 12/2004 | Appo | B23P 15/06 29/888.045 |
| 2007/0107215 | A1* | 5/2007 | Scharp | B21K 1/185 29/888.042 |

(Continued)

FOREIGN PATENT DOCUMENTS

| | | | |
|---|---|---|---|
| AT | 003210 | U1 | 11/1999 |
| DE | 10134293 | A1 | 3/2003 |

(Continued)

OTHER PUBLICATIONS

English abstract for JP-2007263068.

(Continued)

*Primary Examiner* — Marguerite McMahon
(74) *Attorney, Agent, or Firm* — Fishman Stewart PLLC

(57) ABSTRACT

A piston for an internal combustion engine may include a piston head and a piston skirt. The piston head may include a circumferential ring part. In a region of the ring part, the piston head may include a circumferential cooling channel and a circumferential ring support. The ring support may define a wall section of the cooling channel and thereby be directly in contact with the cooling channel. The cooling channel may have a cross-section that may define a contraction disposed in a central area.

17 Claims, 1 Drawing Sheet

(56) References Cited

U.S. PATENT DOCUMENTS

| | | | | |
|---|---|---|---|---|
| 2007/0137605 | A1* | 6/2007 | Scharp | F02F 3/22 123/193.6 |
| 2008/0245335 | A1* | 10/2008 | Kemnitz | F16J 1/09 123/193.6 |
| 2009/0007776 | A1* | 1/2009 | Benz | F02F 3/22 92/160 |
| 2010/0147250 | A1* | 6/2010 | Boczek | F02F 3/22 123/193.6 |
| 2012/0160204 | A1* | 6/2012 | Scharp | F02F 3/22 123/193.6 |
| 2013/0000482 | A1* | 1/2013 | Kopchick | B22C 9/00 92/172 |
| 2014/0150747 | A1* | 6/2014 | Lochmann | F02F 3/00 123/193.6 |
| 2014/0290618 | A1* | 10/2014 | Bischofberger | F02F 3/22 123/193.6 |

FOREIGN PATENT DOCUMENTS

| | | | |
|---|---|---|---|
| DE | 60203122 | T2 | 11/2005 |
| DE | 102005061074 | A1 | 6/2007 |
| DE | 102006013884 | A1 | 9/2007 |
| DE | 102006056013 | A1 | 5/2008 |
| DE | 102011116332 | A1 | 1/2013 |
| JP | 10184450 | | 7/1998 |
| JP | 11082738 | | 3/1999 |
| JP | 2007263068 | A | 10/2007 |
| JP | 2009-215978 | A | 9/2009 |
| JP | 2010-127248 | A | 6/2010 |

OTHER PUBLICATIONS

English abstract for JP-10184450.
English abstract for JP-2010-127248.
English abstract for JP-11082738.
English abstract for JP-2009-215978.
English abstract for AT-003210.
English abstract for DE-102006056013.

* cited by examiner

PISTON

CROSS-REFERENCE TO RELATED APPLICATIONS

This application claims priority to German Patent Application No. 10 2012 215 541.4, filed Aug. 31, 2012, and International Patent Application No. PCT/EP2013/067302, filed Aug. 20, 2013, both of which are hereby incorporated by reference in their entirety.

TECHNICAL FIELD

The present invention relates to a piston for an internal combustion engine, with a piston head and a piston skirt and with a ring part and a cooling channel.

BACKGROUND

A generic piston is known for example from DE 10 2006 056 013 A1. Here, the piston comprises a piston head and a piston skirt projecting therefrom, wherein the piston head has a ring part in which in particular piston rings can be arranged. In particular, for reinforcing the piston, which is typically produced from a light metal, in addition a circumferential ring support is provided in the region of the ring part. Owing to the thermodynamic conditions prevailing in or respectively on the piston, in particular the high temperatures, the piston is additionally provided with a circumferential cooling channel. The cooling channel is arranged here spaced apart from the piston crown and from the ring part within the piston. A disadvantage here is that such an arrangement of the cooling channel constitutes a limitation for the size of a piston bowl on the piston crown.

A ring support for a piston of an internal combustion engine is known from DE 101 34 293 A1. Here, sheet metal part of the ring support is open towards a ring support part of the ring support, in order to form a cooling channel together with the ring support part.

From the applicant's subsequently published patent application DE 10 2011 116 332.1 an aluminium piston with a cooling channel is known, which is constructed with a central contraction. The cooling channel is formed in the piston by a casting process and is arranged radially within a ring support and separated spatially therefrom.

SUMMARY

The present invention is concerned with the problem of indicating for a piston of the generic type an improved or at least alternative embodiment, which is distinguished in particular by an improved cooling and/or by the possibility for the formation of a larger piston bowl.

This problem is solved according to the invention by the subject matter of the independent claims. Advantageous embodiments are the subject matter of the dependent claims.

The present invention is based on the general idea of arranging the cooling channel of the piston for an internal combustion engine at least partially directly on the ring part and in particular on the ring support of the piston, and therefore on the one hand creating space for the formation of a larger piston bowl and on the other hand improving the cooling, in particular in the region of the ring part. In addition, the cooling channel of the piston is configured so that the latter has approximately centrally a contraction in cross-section. The piston according to the invention therefore has a cooling channel which is constructed circumferentially in a piston head of the piston and has a substantially central cross-section contraction. The piston head comprises furthermore said circumferential ring part, in which said ring support, which is likewise circumferential, is arranged. According to the invention, the ring support now forms a wall section of the cooling channel, so that the cooling channel is arranged at least in certain areas directly on the ring support and is in direct contact therewith. Therefore, it is possible in particular to move the cooling channel radially further outwards compared with the generic piston known hitherto, so that a piston bowl, possibly formed in the piston head, in particular in radial direction, can be constructed so as to be larger. Furthermore, through the direct coupling of the cooling channel with the ring support, an improved cooling is ensured in this region. In addition, an improved cooling of the piston is also achieved in the region of the piston bowl, because the piston bowl can be formed nearer to the cooling channel, or respectively the cooling channel can be placed nearer to the piston crown. In addition, the special configuration of the cooling channel with the approximately centrally arranged circumferential narrowing serves in particular for achieving an improved heat transmission and hence for the better cooling of the piston. This cross-section is provided here along the axial direction of the piston.

Accordingly, the cooling channel has a contraction along an axial height of the cooling channel, so that a coolant flowing through the cooling channel on the one hand is accelerated and aligned in a targeted manner through the upward- and downward movement of the piston and through the contraction in the manner of a nozzle, and on the other hand the aligned flow, now limited to a relatively narrow flow cross-section, is forced in the partial volume above and below the contraction respectively into a cylindrical flow. This brings about a substantially higher flow speed of the engine oil which is usually used as coolant along the surface of the cooling channel. Thereby, the heat transmission between the metal and the oil, which per se conducts heat relatively poorly, is considerably improved, whereby the temperature of the piston can be distinctly reduced.

The stabilizing of the piston, in particular of the piston head by means of the ring support is necessary in particular when the piston is produced from a light metal, in particular from aluminium or from a material containing aluminium.

Preferably, the contraction of the cooling channel for forming the cross-section according to the invention is arranged approximately centrally in the cooling channel. In other words: The circumferential cooling channel, which has a usually elongated cross-section extending approximately in the axial direction, i.e. parallel to the piston axis, has a contraction approximately on half of the axial height of the cooling channel. Accordingly, the cooling channel can be constructed symmetrically in cross-section, wherein a symmetry plane or respectively symmetry line or a symmetry point is arranged in the region of the contraction of the cooling channel. In preferred embodiments, an axially symmetrical cross-section can be constructed so as to be kidney-shaped, whereas a point-symmetrical cross-section can be constructed so as to be for instance dumbbell-shaped or respectively in the shape of a figure eight. Preferably, the upper and the lower partial volume are formed here so that a stream of coolant passing axially through the contraction is received eccentrically and substantially tangentially into a dome-shaped rounding-out at the upper or respectively lower end of the cooling channel. Thereby, the kinetic energy of the oil is used largely for generating the desired cylindrical movement according to the invention in the upper or respectively lower partial volume, which improves the heat transmission.

Instead of entering tangentially into a dome-shaped rounding-out, the oil jet could, however, after its passage through the contraction, alternatively also strike onto the end region in a central jet. For this, in the upper and/or lower end region of the cooling channel preferably respectively a circumferential rib is present, acting as a jet splitter. The rib preferably has a sharp circumferential edge projecting in axial direction, onto which a face, curved in a concave manner, adjoins respectively radially inside and outside. With the cooling channel surface thereby advantageously two concentric dome-shaped roundings-out are produced, which on both sides of the edge of the rib respectively deflect a portion of the coolant stream and set it into two cylindrical flows according to the invention, rotating in opposition. The cooling channel according to the invention can be constructed with such a jet splitter only above, only below or on both sides. In the latter case, the cooling channel according to the invention can also have an e.g. dumbbell-shaped cross-section, which can be symmetrical to an axial and/or a radial axis.

Advantageously, the ring support is thicker radially inwards, in order in particular to ensure a better or respectively more stable arrangement of the ring support in the region of the ring part. It is critical here that an upper ring support wall in axial direction and an axially lower ring support wall of the ring support run aligned to one another in cross-section, in order to enable a better hold of the ring support in the piston body. This means that the ring support in cross-section has an axial ring support height which increases radially inwards. A preferred ring support of Ni-Resist has a smaller coefficient of thermal expansion than a typical piston material, such as e.g. an Al—Si alloy. After cooling, the radially inwardly expanding ring support can therefore rest via its faces on the piston and is held in a form-fitting manner in its groove. Such a configuration of the ring support is advantageous in particular when the piston is cast. Here, the ring support can be inserted into a corresponding casting mould during or respectively before the casting process. Accordingly, the ring support preferably has a cross-section which increases radially inwards.

In particular, the cross-section of the ring support can be formed in the manner of a rectangle, for example in the manner of a trapezium, in the manner of a triangle or in the manner of a polygon or suchlike.

In preferred embodiments, the ring support is produced from a nickel alloy, such as e.g. Ni-Resist. Therefore, the ring support can reduce wear occurring on the piston ends, produced preferably from light metal, for example from aluminium or an aluminium alloy, in the first ring groove.

In preferred embodiments, the piston is produced by a casting process, wherein the cooling channel is preferably formed by means of an insert part in the piston. Alternatively, the cooling channel could also be formed in a substantially ring-shaped cast part, which is arranged on an otherwise forged piston. This means that the insert part forming the cooling channel is inserted in a corresponding casting mould for the production of the piston or respectively of the cast part and is subsequently cast around by the material forming the piston. Accordingly, the insert part can be configured as a sand core or respectively salt core, which subsequent to the casting process is flushed out from the piston.

Preferably, however, the insert part for the formation of the cooling channel is a sheet metal part which is welded or soldered onto the ring support and forms the cooling channel between the two. This has the advantage that the desired form of the cooling channel can be realized by a simple shaping of the insert part, which is configured as a sheet metal part. In particular therefore the cross-sectional shape of the cooling channel with its substantially central contraction can be produced comparatively simply, without relatively fragile salt cores having to be used owing to the desired shape. Apart from this, with a sheet metal part in the first place such cooling channel geometries can be realized in which the ring support forms e.g. a projection protruding on the radially outer side into the cooling channel. Whereas a salt suitable for this could not be placed onto the ring support from any of the two axial directions, a corresponding sheet metal part can be bent in a suitable manner after placing onto the ring support.

Further important features and advantages of the invention will emerge from the subclaims, from the drawings and from the associated figure description with the aid of the drawings.

It shall be understood that the features mentioned above and to be explained further below are able to be used not only in the respectively indicated combination, but also in other combinations or in isolation, without departing from the scope of the present invention.

Preferred example embodiments of the invention are illustrated in the drawings and are explained in further detail in the following description, wherein the same reference numbers refer to identical or similar or functionally identical components.

BRIEF DESCRIPTION OF THE DRAWINGS

There are shown, respectively diagrammatically.

DETAILED DESCRIPTION

Figure 1:
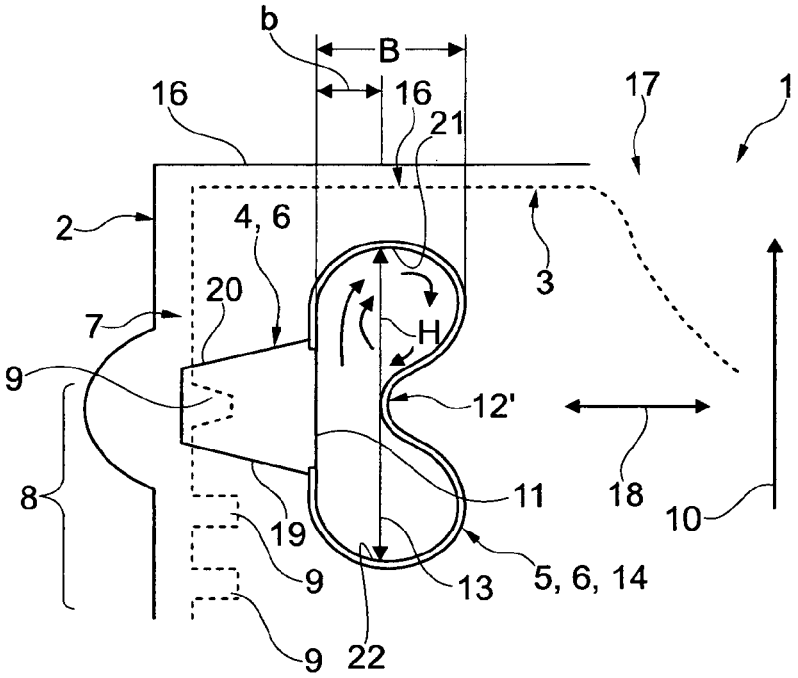
FIG. 1 a longitudinal section through a piston according to a first embodiment, FIG. 2 a longitudinal section through a piston according to a second embodiment.

FIG. 1 shows a piston 1, which is produced by means of a casting process. Here, a casting mould 2 of the piston 1 is illustrated by means of a continuous line, whereas a finished shape 3 of the piston 1 is illustrated by a dashed line. To reach the finished shape 3, the casting mould 2 is worked for example by a turning method, or milled. The piston 1 has in addition a ring support 4 and a cooling channel 5, which are previously welded or soldered as an insert part 6 and are accordingly introduced into a corresponding casting mould before the casting of the piston 1, and are subsequently cast around by the material, in particular aluminium, forming the piston 1. Here, the ring support 4 is preferably produced from Ni-Resist, and the cooling channel 5 from austenitic steel/sheet metal.

The piston 1 comprises in addition a piston head 7 and a ring part 8 constructed circumferentially in the piston head 7. In the ring part 8 several, here three, ring grooves 9 are formed, serving to receive piston rings, wherein one of these ring grooves 9 is formed in the radially outer region of the ring support 4. Here, the radial direction indicated by an arrow 18 is given with respect to an axial axis 10 of the piston 1 and runs accordingly perpendicularly thereto.

According to the invention, the cooling channel 5 is arranged in certain areas directly on the ring support 4, so that the ring support 4 forms a wall section 11 of the cooling channel 5. Accordingly, the ring support 4 and the cooling channel 5 are in direct contact, so that the cooling channel 5 on the one hand can be arranged radially as far as possible outwards and in addition ensures an improved cooling of the ring part 8.

As can be seen in FIG. 1, the cooling channel 5 is constructed such that it has a kidney-shaped cross-section. The kidney-shaped cross-section is realized by means of a contraction 12, which lies in the region of approximately half of an axial height 13 of the cooling channel 5. This shape of the cooling channel 5 is realized by means of a shaping of the insert part 6, configured as sheet metal part 14, for the formation of the cooling channel 5. In addition, the cooling channel 5, formed in the shape of a kidney, is constructed largely symmetrically, wherein a corresponding symmetry line or respectively symmetry plane runs in the region of the contraction 12 of the cooling channel 5.

The relationships of the dimensions of the cooling channel 5 here are preferably to be as follows:

$$H \geq 2B \text{ and } b \leq 0.5B$$

The first relationship enables a sufficiently great volume to receive the coolant, whereas the second relationship is of importance for the acceleration of the coolant, for example oil. With a maintaining of these relationships, a particularly effective cooling can be achieved, in particular through the cylindrical movement of the coolant in the cooling channel 5.

A cooling channel cover 21 of the cooling channel 5 is constructed substantially so as to be dome-shaped or barrel-shaped. In the example embodiment shown according to FIG. 1, the contraction 12 has the same distance from the cooling channel base 22 and from the cooling channel cover 21, whereby the coolant, in the region of the cooling channel cover 21, is forced into a circularly circumferential flow, as is indicated by the circular arrows, so that the coolant can interact several times per piston stroke with the wall of the cooling channel 5 in the region of a piston crown 16 and of the piston bowl 17. Here, coolant of lower temperature is always accelerated through the contraction 12 and subsequently delivered. To optimize this effect, in the example embodiment the radial measurement B of the substantially dome-shaped cooling channel cover 21 at its widest point is at least equal to twice the radial measurement b of the contraction 12, i.e. $B \geq 2 \times b$. In this case, the formation of a cylindrical flow is promoted in that the coolant of lower temperature enters eccentrically and preferably tangentially into the rounding of the dome-shaped cooling channel cover and is thereby not substantially impeded in its flow by the coolant which is already deflected from the cooling channel cover 21 and flowing back.

Generally, the accelerated oil flow through the contraction 12 leads to an improved cooling of the ring support 4, to which also the increasing thickness of the ring support 4 radially inwards and the thereby enlarged contact surface of the ring support 4 for the coolant contributes. The cylindrical movement of the coolant increases the speed of flow of the oil inter alia along the dome-shaped cooling channel cover 21 and improves there the heat transmission and thereby the cooling of the piston crown 16 and of the bowl edge or respectively the piston bowl 17.

The piston 1 has in addition a piston skirt 15, not illustrated in detail, which is arranged on the side of the piston head 2 projecting from a piston crown 16 of the piston head 2 and projects axially from the piston crown 16. The piston 1 comprises in the piston crown 16 a piston bowl 17. Through the arrangement of the cooling channel 5 on the ring support 4 it is possible here to form the piston bowl 17 larger in particular in radial direction, in order for example to achieve a better mixing or respectively combustion of an air-fuel mixture in an associated combustion chamber of an associated internal combustion engine.

Figure 2:
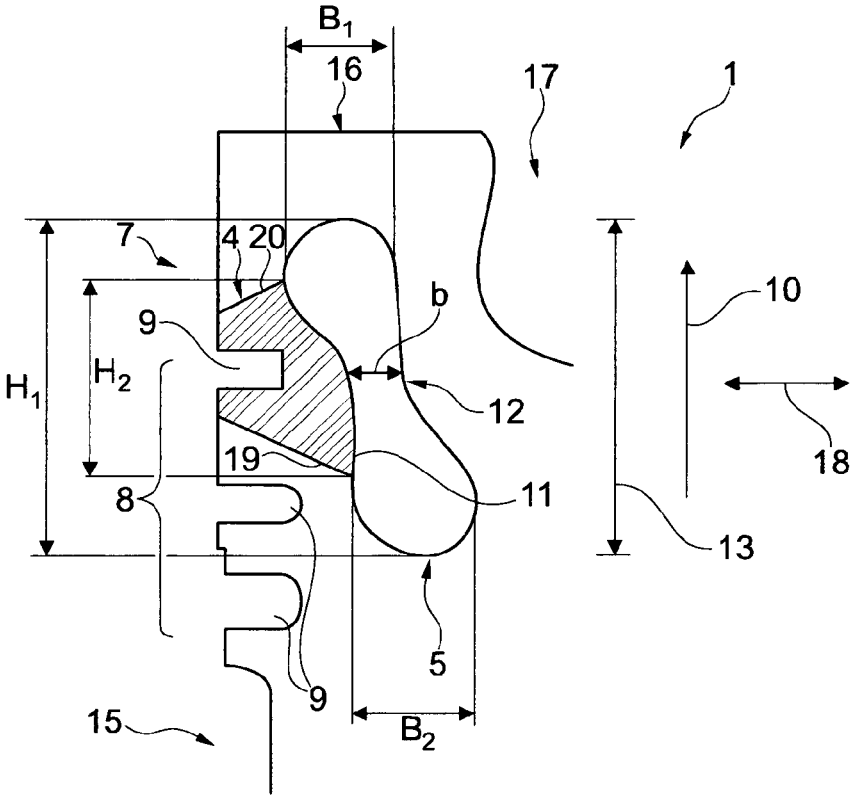

FIG. 2 shows a further variant of the piston 1 according to the invention. In contrast to the piston 1 shown in FIG. 1, the cooling channel 5 in the embodiment shown in FIG. 2 is arranged tilted in radial direction. Thereby, a substantially axially aligned flow in the region of the contraction 12 on the radial inner side enters into the dome-shaped cooling channel cover, whilst in the opposite direction it flows on the radially outer side into the dome-shaped cooling channel base. The cross-section can thereby have e.g. the shape of a slightly oblique "8" according to FIG. 2. Thereby, the shape of the cooling channel can be adapted more precisely to the shape of the piston bowl 17 and the heat transmission can be improved, without having to deviate from an axial through-flow of the contraction 12.

The contraction 12 takes place here from both radial sides of the cooling channel 5, so that the corresponding wall section 11, in contrast to the straight-running wall section 11 of the embodiment shown in FIG. 1, runs in a curved manner and follows the course of a dumbbell-shaped cross-section or respectively a cross-section in the shape of a figure 8 of the cooling channel 5. In other words, on the radially inner and the radially outer cooling channel side, material elevations are present which are offset to one another in axial direction, which overlap one another in the axially central region and thereby form the contraction 12 according to the invention. Similarly to the example of FIG. 1, the coolant, which is accelerated owing to the shaker effect, passes substantially in axial direction through the contraction 12 and subsequently tangentially into the dome-shaped upper or respectively lower cooling channel cover 21, 22, in order to promote the formation according to the invention of a cylindrical flow in the upper or respectively lower partial volume of the cooling channel 5. Through this "tilted" arrangement of the cooling channel 5, not symmetrical to a horizontal plane, an improved adaptation to the piston geometry and a further enlargement of the piston bowl 17, in particular in radial direction, is possible.

As can be further seen in FIGS. 1 and 2, the ring supports 4 have in cross-section a conical cross-section with a radially inwardly increasing cross-section. This means that the ring support which is respectively shown thickens along the radial direction 18 directed to the piston bowl 17, or respectively narrows along the opposite radial direction 18. Here, an axially lower ring support wall 19 and an axially upper ring support wall 20 of the ring support 4 run in cross-section aligned to one another and accordingly not parallel in the examples which are shown, wherein the terms lower and upper refer to the illustration which is shown. Such a configuration of the respective ring support 4 enables a better arrangement or respectively a better hold of the ring support in the piston, in particular in the case of a ring support 4 constructed as an insert part 6.

Here, the ring support 4 shown in FIG. 1 has a trapezoidal cross-section, so that the wall section 11, as mentioned, runs straight in cross-section. The ring support shown in FIG. 2 likewise has a cross-section in the manner of a trapezium, wherein the wall section 11 has a shape adapted to the centrally contracted shape of the cooling channel 5.

Observing the embodiment according to FIG. 2 further, relationships with respect to the dimensions of the cooling channel 5 are indicated there as follows:

$$H_1 \geq B_1 + B_2 \text{ and } b \leq 0.5 \min(B_1, B_2)$$

The first relationship brings about here a sufficiently large space to receive the coolant, whereas the second relationship brings about the necessary cylindrical movement of the coolant, because also in the smaller of the two dome volumes the tangentially entering flow remains largely separated from a counter-flow deflected in the dome. Mathematically, this is expressed by the minimum function. These conditions, which are particularly influential for the cooling, are additionally supported by the following condition:

$$H_2 \geq 0.5(B_1+B_2)$$

In a preferred, but not necessary embodiment of the present invention, the following applies here: $B_1=B_2$. Altogether with such a cooling channel geometry a particularly effective cooling of the piston 1 can be achieved.

The invention claimed is:

1. A piston for an internal combustion engine, comprising:

a piston head and a piston skirt, wherein the piston head includes a circumferential ring part and, in a region of the ring part, the piston head includes a circumferential cooling channel and a circumferential ring support, the ring support defining a wall section of the cooling channel thereby directly contacting the cooling channel, wherein the cooling channel has a cross-section defining a contraction disposed in a central area, and wherein the cross-section defines one of a point-symmetrical profile or an axially symmetrical profile with respect to a radial axis.

2. The piston according to claim 1, wherein the contraction extends half of an axial height of the cross-section of the cooling channel.

3. The piston according to claim 1, wherein the contraction of the cross-section is defined by a circumferential projection extending radially in a direction towards the ring part from an inner side of the cooling channel opposite the ring part.

4. The piston according to claim 3, wherein the cross-section of the cooling channel defines a kidney-shaped profile.

5. The piston according to claim 1, wherein the cross-section of the cooling channel includes, with respect to an axial direction, the following dimensions: a height (H1), a first maximum radial width (B1) in a region arranged on one side of the contraction facing a piston crown of the piston head, a second maximum radial width (B2) in a region arranged on another side of the contraction facing away from the piston crown, and a third minimum radial width (b) in a region of the contraction, wherein:

$$H1 \geq B1+B2 \text{ and } b \leq 0.5*\min(B1,B2).$$

6. The piston according to claim 5, wherein the ring support defines a surface adjoining the cooling channel and has an axial height (H2), wherein:

$$H2 \geq 0.5*(B1+B2).$$

7. The piston according to claim 1, wherein the ring support has a cross-section increasing radially in a direction away from the ring part.

8. The piston according to claim 1, wherein the piston is produced by a casting process and the cooling channel is an insert part.

9. The piston according to claim 8, wherein the insert part is a sheet metal part formed via a deforming process.

10. The piston according to claim 2, wherein the contraction is defined by a circumferential projection extending radially in a direction towards the ring part from an interior side of the cooling channel opposite the ring part.

11. The piston according to claim 10, wherein the cross-section of the cooling channel defines a kidney-shaped profile.

12. The piston according to claim 1, wherein the ring support has a cross-section increasing radially in a direction away from the ring part.

13. The piston according to claim 1, wherein the contraction is defined by a circumferential projection extending radially in a direction towards the ring part from an interior side of the cooling channel opposite the ring part.

14. The piston according to claim 13, wherein the cross-section of the cooling channel defines a kidney-shaped profile.

15. The piston according to claim 1, wherein the ring support has a cross-section increasing radially in a direction away from the ring part.

16. A piston for an internal combustion engine, comprising:

a piston head;

a circumferential ring part extending around a periphery of the piston head;

a cooling channel radially spaced from the ring part, the cooling channel extending circumferential about the piston head;

a circumferential ring support disposed radially between the ring part and the cooling channel, the ring support defining a wall section of the cooling channel;

wherein the cooling channel includes a cross-section defining a contraction disposed in a central area, the contracting including a circumferential projection extending radially in a direction towards the ring part from an inner side of the cooling channel opposite the ring part, wherein the cross-section of the cooling channel defines a profile having a kidney-shape, the profile of the cross-section being axially symmetrical with respect to a radial axis.

17. A piston for an internal combustion engine, comprising:

a piston head and a piston skirt, wherein the piston head includes a circumferential ring part and, in a region of the ring part, the piston head includes a circumferential cooling channel and a circumferential ring support, the ring support defining a wall section of the cooling channel thereby directly contacting the cooling channel, wherein the cooling channel has a cross-section defining a contraction disposed in a central area, and wherein the cross-section of the cooling channel includes, with respect to an axial direction, the following dimensions: a height (H1), a first maximum radial width (B1) in a region arranged on one side of the contraction facing a piston crown of the piston head, a second maximum radial width (B2) in a region arranged on another side of the contraction facing away from the piston crown, and a third minimum radial width (b) in a region of the contraction, wherein:

$$H1 \geq B1+B2 \text{ and } b \leq 0.5*\min(B1,B2).$$

* * * * *